United States Patent [19]

Hise

[11] Patent Number: 4,956,048

[45] Date of Patent: Sep. 11, 1990

[54] METHOD OF ALCOHOL WASHING BROWNSTOCK PULP PRIOR TO A CHLORINATION BLEACHING STAGE

[75] Inventor: Ronnie G. Hise, Charleston, S.C.

[73] Assignee: Westvaco Corporation, New York, N.Y.

[21] Appl. No.: 338,320

[22] Filed: Apr. 17, 1989

[51] Int. Cl.[5] ..... D21C 9/02; D21C 9/12; D21C 9/14

[52] U.S. Cl. ..... 162/60; 162/77; 162/87; 162/88; 162/89

[58] Field of Search ..... 162/77, 89, 88, 60, 162/87

[56] References Cited

U.S. PATENT DOCUMENTS 2,042,705 6/1936 Dreyfus ..... 162/77

OTHER PUBLICATIONS

Liebergott et al "Oxidative Bleaching–A Review"; Paper presented at 69th Annual Meeting Technical Section, Feb. 1 & 2, 1983.

Williamson, "Repap's ALCELL TM Process:", *Pulp & Paper, Canada,* Dec. 1987 pp. 47–49.

*Primary Examiner*—Steve Alvo

*Attorney, Agent, or Firm*—Terry B. McDaniel; Richard L. Schmalz

[57] ABSTRACT

In the method of chemical pulping of wood including a chlorination stage pulp bleaching step followed by alkaline extraction, a method of reducing the amount of dioxins and furans produced thereby is disclosed wherein the brownstock pulp is first washed with alcohol prior to bleaching.

4 Claims, 1 Drawing Sheet

METHOD OF ALCOHOL WASHING BROWNSTOCK PULP PRIOR TO A CHLORINATION BLEACHING STAGE

BACKGROUND OF THE INVENTION

1. Field of the Invention

This invention relates to an improvement in chlorination stage bleaching in the process of chemical delignification of wood chips. More particularly, this invention relates to washing unbleached softwood pulp with alcohol which results in diminished production of chlorinated dioxins and furans during subsequent chlorination and alkaline extraction stages. The alcohol of choice is a mono-hydric alcohol such as methanol, ethanol, propanol, isopropanol, or octanol. The preferred alcohol is ethanol.

2. Description of the Prior Art

Four ingredients are necessary to make paper: (1) raw materials—such as wood from the forest; (2) energy—from coal, oil, gas, or wood by-products, e.g., bark or wastes from the paper making process itself; (3) water, much of which is used as a conveyer belt to transport material along the process and is recirculated, but some of which is discharged to the atmosphere as vapor from driers or as liquid after purification in a waste treatment plant; and (4) skilled operators and management.

Not all pulps are produced chemically. "Groundwood" or "mechanical pulp," as the names imply, is produced by grinding a log of wood against abrasive stone surfaces or between rotating steel discs with cutting bars against their faces to yield fibers and fragmented fiber bundles. Such pulp is used in newsprint and similar paper where high opacity and good printability are desirable properties but where mechanical strength is not a prime requirement.

Chemical pulping begins with cutting the wood into chips. The chips are screened, rejects being both oversize slivers or undersize fines, and are taken to the top of a "digester" or a high pressure cooking vessel. Chemicals are added and the reaction is allowed some time under a prescribed program of temperatures, for the lignin of the wood and some hemicelluloses to be dissolved and extracted from the chips. Then the cooked material is discharged discontinuously in a batch process or continuously into a blow-tank where steam and other volatiles are flashed off. The cooking liquor—which is now a "black liquor" because of the dissolved lignin—is passed on to a chemical recovery cycle.

The pulp is washed with water to remove black liquor on, for example, a series of wire covered rotating drums. The washed brown stock is screened, diluted, and may be passed on to arrays of centrifugal cyclonic cleaners to separate large and heavy "dirt"—e.g., silica or metal particles—before bleaching. Since the screening operation and cyclone cleaners are only efficient with dilute suspensions, while bleaching requires higher consistencies for economical reasons, the stock is "thickened" by extracting some of its water, using wire covered, perforated drums on which the stock is made to form a mat.

The thick brown stock is next subjected to a series of bleaching operations. These can vary widely both in the types of chemicals used and their sequences.

In a favored system called CEDED, (Chlorine-Extraction-chlorine Dioxide-Extraction-chlorine Dioxide) the pulp is first delignified with chlorine gas, then extracted with sodium hydroxide and finally bleached with chlorine dioxide. As is well known in the art, this first chlorination stage of bleaching often involves various combinations of chlorine and chlorine dioxide. Chlorine dioxide attacks lignin specifically to a far greater extent than it attacks cellulose—unlike chlorine which is a more indiscriminate oxidant—but it is more expensive. Thus, it is preferably used for the final steps. After the final bleaching, the bright stock is washed to leave the pulp mill and enter the paper mill.

Much concern has been expressed about the environmental effects of chlorinated compounds formed by bleaching chemical pulp. Although investigations are incomplete and debate continues as to whether these compounds represent any true risk to the environment, special attention has been given chlorinated dibenzo-p-dioxins and dibenzofurans. Results, previously obtained by analyzing sediments sampled outside a pulp mill, suggest that there exists a very close correlation between these groups of compounds as reported at the 7th International Symposium on Chlorinated Dioxins and Related Compounds (Dioxin '87) in Las Vegas, Nev. Studies have indicated that 2,3,7,8-tetrachlorodibenzofuran (2378-TCDF) can be used as an indicator of the presence of 2,3,7,8-tetrachlorodibenzodioxin (2378-TCDD), the corresponding chlorinated dioxin isomer, at lower levels.

Practical means for preventing or reducing formation of these and related compounds are being sought in laboratory and mill studies. Certain approaches, such as oxygen delignification or high substitution of chlorine dioxide for chlorine in the chlorination stage, involve great expense, both in terms of capital equipment and processing costs. In addition to cost, significant time is required to implement these options. Some inexpensive, shorter term solution is desired.

The prior art approaches to the reduction of TCDD/F levels have focused primarily on modification of the chlorination stage of bleaching. Swedish researchers, for example, have claimed that TCDD/F levels are exponentially related to the "chlorine multiple" or "Kappa factor"—actually saying that the critical factor is the amount of chlorine applied to a certain amount of lignin ("The Influence of Lignin Content and Bleaching Chemicals on the Formation of Chlorinated Dioxins, Dibenzofurans and Phenolics" by Axegard et al. and "Influence of Oxygen Pretreatment and Chlorine Ratio on the Formation of PCDDs and PCDFs in Pulp Bleaching" by Swanson et al., presented at the Dioxin '88 Conference in Umea, Sweden.). On the other hand, co-pending U.S. patent application Ser. No. 262,534 reports the discovery that the amount of chlorine actually may remain at conventional levels as long as the concentration of chlorine does not exceed a definite level at any time during the chlorination bleaching stage, as a method for controlling formation of these undesirable compounds.

Washing the pulp after chlorination with excess water lowered the levels of 2378-TCDD and 2378-TCDF in the subsequent E-stage by only 5–10%. This suggests that the potential is low for removing chlorinated dioxins and furans from bleached pulp by improved bleach plant washing.

SUMMARY OF THE INVENTION

It has been discovered that washing unbleached softwood pulp with aqueous alcohol decreases the amount of chlorinated dioxins and furans formed during subsequent chlorination and alkaline extraction stages by 80%, or higher, as compared to a control representing the prior art method which omits such pre-chlorination washing step.

DESCRIPTION OF THE PREFERRED EMBODIMENTS

Figure 1:
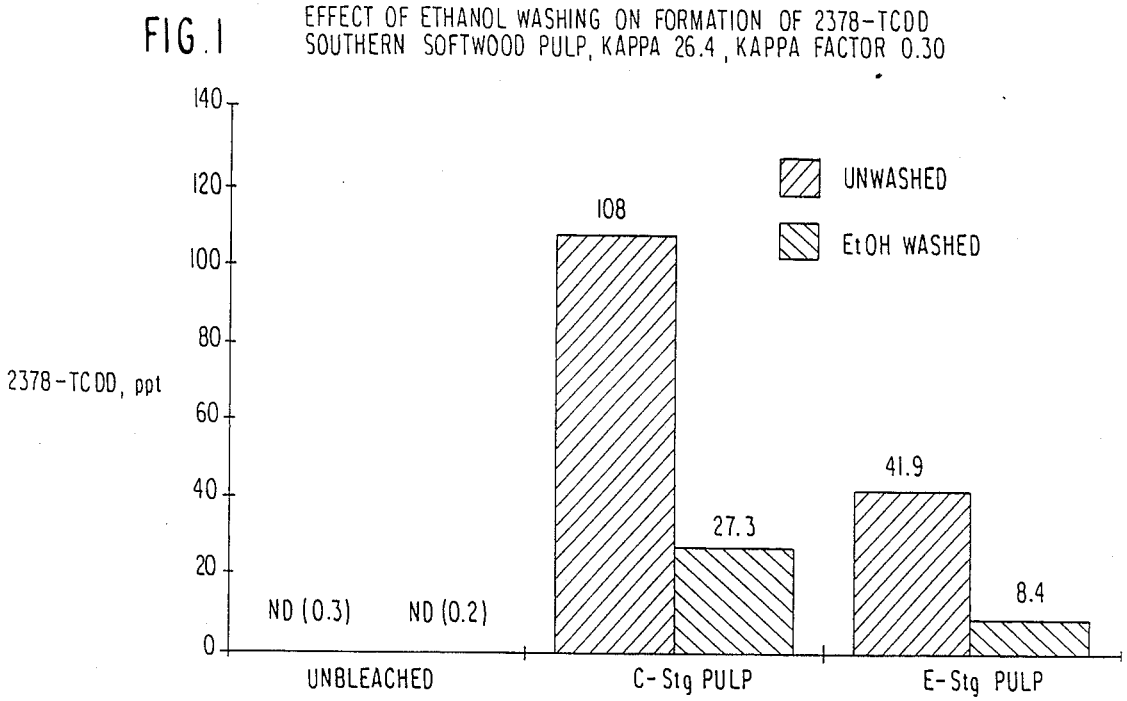
FIG. 1 is a bar graph depiction of the relative quantities of 2378-TCDD formation in parts per trillion during the chlorination and extraction bleaching stages of pulping unbleached, screened, softwood pulp washed with ethanol as compared to bleaching the pulp "as is" from the paper mill.

Unbleached, screened softwood pulp was collected from a mill. The Kappa number was determined using TAPPI Useful Method T236 os-76. An aliquot of the pulp was bleached through the chlorination and extraction stages with no additional prewashing or processing. Another aliquot was extensively washed with water, and aqueous and absolute ethanol before bleaching. A Kappa factor (defined as $KF=[\% \ Cl_2+(\% \ ClO_2\times 2.63)]/\text{Kappa number}$) of 0.30 was used in all chlorinations with 10% substitution of $ClO_2$, added 15 seconds after $Cl_2$-water. The unbleached pulp Kappa number did not change significantly after ethanol washing as compared to the original pulp. After chlorination the pulp slurry was simply thickened with no additional washing to maximize TCDD/F concentrations in the pulp. High chlorine charges were used to ensure formation of measurable levels of TCDD/Fs.

Example

Replicate experiments were conducted according to the following procedures:

Alcohol Washing. The desired quantity (200 grams) of unbleached softwood pulp was slurried in water at 1% consistency and stirred mechanically for ten minutes. The slurry was filtered using a 300 mesh screen in a large Buchner funnel. (Contact with plastics and paper were avoided—all glassware was rinsed before use with absolute ethanol). The "first pass" filtrate was poured back through the formed pad of pulp to retain fines and fibers. As much filtrate was removed as possible using aspirator vacuum.

The pulp was then washed (without disrupting the pad) with a volume of 50% aqueous ethanol equivalent to three times the estimated water content of the pad. The ethanol was added without vacuum on the Buchner funnel, allowed to sit one minute, and then pulled through the pad by suction. No fines loss was noted by visual inspection of the lightly colored filtrate. This washing was repeated with warm (45° C.) absolute (200 proof) ethanol, then again with 50% aqueous ethanol, and finally with portions of hot deionized water until the ethanol odor in the pulp was not detectable.

The pad was mixed in a Hobart mixer. Pulp Kappa number was found to be unchanged as compared to the unwashed sample. Yield was near 96% after ethanol washing.

The effect of ethanol washing on removal of DBD and DBF from the first experiment is shown in Table I, which indicates that ethanol washing is more effective in removing DBD from unbleached pulp (180 to 7.2 ppt) as compared to removal of DBF (5600 to 1540 ppt).

TABLE I

Effect of Ethanol Washing on Removal of Dibenzo-p-Dioxin (DBD) and Dibenzofuran (DBF) from Softwood Brownstock Pulp

| Sample Description | DBD (ppt) | DBF (ppt) |
|---|---|---|
| Control (as is) | | |
| Unbleached pulp | 189 | 5600 |
| C-Stage pulp | 60 | 4590 |
| E-Stage pulp | 22 | 2700 |
| EtOH Washed | | |
| Unbleached pulp | 7.2 | 1540 |
| C-Stage pulp | 4.5 | 3940 |
| E-Stage pulp | 8.9 | 2320 |

Chlorination Stage. Seventy-gram batches (oven dried basis) of pulp at 3% consistency were chlorinated in a two-liter continuously stirred reactor. Chlorination temperature was 50° C., retention time one hour in each case. All were conducted at 10% substitution of $ClO_2$, added 15 seconds after injection of chlorine water. Residual active chlorine in the filtrate was determined following the reaction. Chlorinated K-numbers (25 ml) were determined as well. See Table II for additional experimental details.

TABLE II

| | Experimental Conditions | | | |
|---|---|---|---|---|
| | Experiment 1 | | Experiment 2 | |
| | Un-washed | EtOH Washed | Un-washed | EtOH Washed |
| Before Chlorination | | | | |
| Kappa Number | 26.4 | 26.4 | 26.4 | 26.4 |
| Viscosity (cp) | 27.1 | 27.3 | 27.1 | 27.3 |
| Chlorination | | | | |
| % Solids | 10.4 | 14.4 | 10.4 | 14.4 |
| OD Pulp Used, g | 70 | 70 | 300 | 290 |
| $ClO_2$ Used, ml | 29.5 | 29.5 | 124.0 | 109.3 |
| $Cl_2$—$H_2O$, ml | 581.7 | 586.5 | 2647 | 2648 |
| Final pH | 1.4 | 1.4 | 1.6 | 1.6 |
| Consumption of $Cl_2$, % | 99.4 | 99.9 | 99.8 | 100.0 |
| Actual $Cl_2$ Consumption, % on OD Pulp | 7.9 | 7.9 | 7.9 | 7.9 |
| 25 ml K number | 6.7 | 7.9 | 6.4 | 6.3 |
| Extraction | | | | |
| % Solids | 14.4 | 15.6 | 14.0 | 15.2 |
| OD Pulp Used, g | 40.0 | 40.0 | 60.0 | 60.0 |
| Alkali, % | 3.0 | 3.0 | 3.0 | 3.0 |
| Initial pH | 11.7 | 11.9 | 12.5 | 12.9 |
| Final pH | 8.1 | 8.5 | 9.8 | 9.5 |
| 25 ml K number | 3.6 | 3.9 | 3.4 | 3.4 |

Extraction Stage. Forty-gram batches were extracted at 70° C. in a stainless steel Parr reactor for one hour. Testing on this pulp included viscosity and CE K number. Initially, there was a significant difference in both chlorinated pulp K number and CE K number, comparing EtOH washed and unwashed samples. When the experiment was repeated, both the ethanol washed and unwashed pulps had the same lignin content after the CE stages. This apparent difference in applied $Cl_2$ did not have a major effect on the formation of TCDD/F during bleaching, as shown in Table III.

Analytical.

Aliquots of unbleached, chlorinated and extracted pulps were analyzed for TCDD/F and the resulting data is set forth in Table III.

TABLE III

Effect of Ethanol Washing on Formation of Chlorinated Dibenzo-p-Dioxins and Dibenzofurans from Softwood Pulp

| | 2378-TCDD, ppt | | | 2378-TCDF, ppt | | |
|---|---|---|---|---|---|---|
| | Experiment #1 | Experiment #2 | Avg. | Experiment #1 | Experiment #2 | Avg. |
| C-Stage Brownstock | | | | | | |
| Control | 123 | 93.6 | 108 | 1240 | 1230 | 1240 |
| EtOH-Washed | 20.7 | 33.8 | 27.3 | 203 | 230 | 217 |
| % Reduction with EtOH | 83 | 64 | 75 | 84 | 81 | 83 |
| E-Stage Brownstock | | | | | | |
| Control | 48.9 | 34.9 | 41.9 | 555 | 510 | 533 |
| EtOH-Washed | 6.5 | ND(10.3) | 8.4* | 70.9 | 97.8 | 84.0 |
| % Reduction with EtOH | 87 | 71* | 80* | 87 | 81 | 81 |

*These values are calculated using the detection limit of 10.3 ppt.

Figure 2:
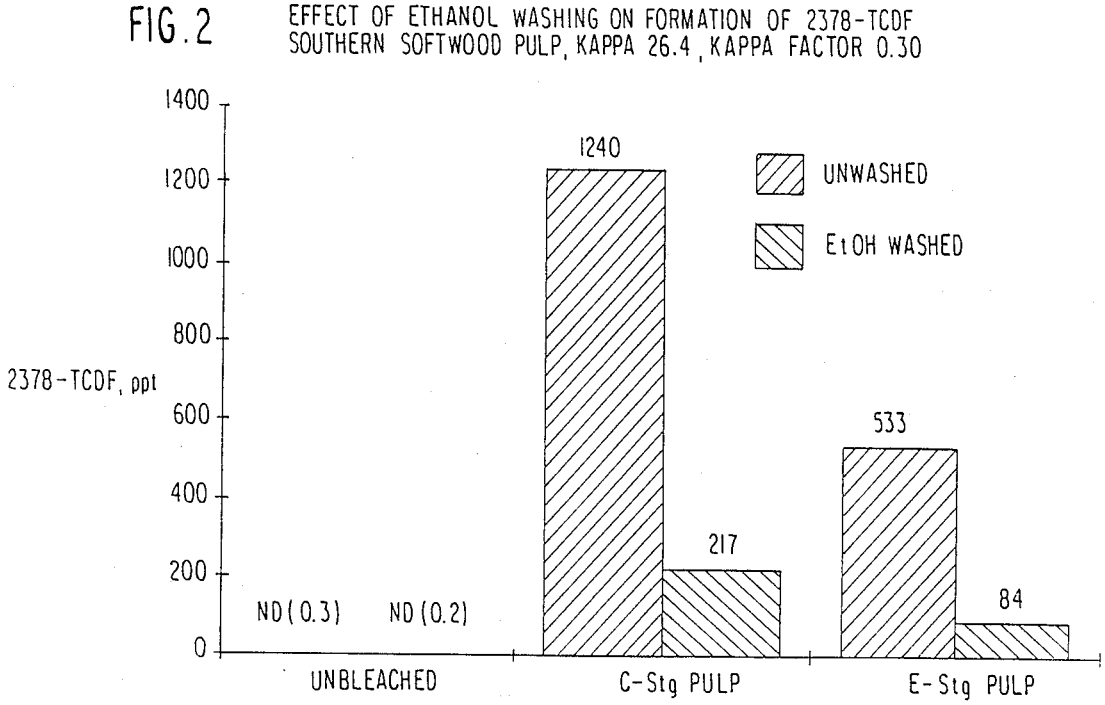
FIG. 2 is a bar graph depiction of the relative quantities of 2378-TCDF formation in parts per trillion during the chlorination and extraction bleaching stages of pulping unbleached, screened, softwood pulp washed with ethanol as compared to bleaching the pulp "as is" from the paper mill.

The averages of the formation of 2378-TCDD and 2378-TCDF in the two experiments are shown graphically in FIGS. 1 and 2, respectively. These results demonstrate the presence of solvent-extractable precursors for TCDD/Fs associated with this unbleached pulp. Washing unbleached, screened, softwood pulp with ethanol substantially reduced the formation of 2378-TCDD and 2378-TCDF in laboratory chlorination and extraction stages as compared to bleaching the pulp "as is" from the mill.

While the invention has been described and illustrated herein by reference to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. An improved method of chemical pulping and bleaching comprising bleaching brownstock chemical pulp with a chlorination stage followed by a lignin extraction stage and producing an amount of chlorinated dioxins and furans as a by-product of the bleaching, wherein the improvement comprises reducing the amount of chlorinated dioxins and furans up to at least 80% by washing the pulp with alcohol prior to the chlorination bleaching stage, wherein the alcohol washing does not significantly change the Kappa No. of the chemical pulp.

2. The improved method of claim 1 wherein the pulp is softwood pulp and the chlorination stage includes subjecting the pulp to combinations of chlorine dioxide and chlorine.

3. The method of claim 2 wherein the alcohol is selected from the group consisting of methanol, ethanol, propanol, isopropanol, and octanol.

4. The method of claim 3 wherein the alcohol is ethanol.

* * * * *